US011655672B2

(12) United States Patent
Liang et al.

(10) Patent No.: US 11,655,672 B2
(45) Date of Patent: May 23, 2023

(54) DEVICE FOR RESTRICTING TORSION SPRING OF SCROLLING DEVICE OF WINDOW CURTAIN FROM REVERSELY EXPANDING

(71) Applicants: Wen Ying Liang, Changhua County (TW); Jian Zhi Huang, Changhua County (TW)

(72) Inventors: Wen Ying Liang, Changhua County (TW); Jian Zhi Huang, Changhua County (TW)

(73) Assignee: CHING FENG HOME FASHIONS CO., LTD., Changhua County (TW)

( * ) Notice: Subject to any disclaimer, the term of this patent is extended or adjusted under 35 U.S.C. 154(b) by 82 days.

(21) Appl. No.: 17/225,967

(22) Filed: Apr. 8, 2021

(65) Prior Publication Data

US 2022/0178202 A1 Jun. 9, 2022

(30) Foreign Application Priority Data

Dec. 9, 2020 (TW) ..... 109216284

(51) Int. Cl.
*E06B 9/60* (2006.01)
*E06B 9/44* (2006.01)
*E06B 9/50* (2006.01)

(52) U.S. Cl.
CPC ..... *E06B 9/60* (2013.01); *E06B 9/44* (2013.01); *E06B 9/50* (2013.01)

(58) Field of Classification Search
CPC ..... E06B 9/60; E06B 9/44; E06B 9/50; E06B 9/68; E06B 9/322; E06B 9/56; E06B 9/88; E06B 9/84; E06B 9/72; E06B 9/38
USPC ..... 160/313
See application file for complete search history.

(56) References Cited

U.S. PATENT DOCUMENTS

| | | | | |
|---|---|---|---|---|
| 9,631,425 | B2 * | 4/2017 | Campagna | E06B 9/72 |
| 10,364,602 | B2 * | 7/2019 | Kwak | E06B 9/60 |
| 10,450,798 | B2 * | 10/2019 | Anthony | E06B 9/44 |
| 10,501,988 | B2 * | 12/2019 | Fisher | E06B 9/84 |
| 10,753,148 | B2 * | 8/2020 | Jay | E06B 9/88 |
| 11,306,535 | B2 * | 4/2022 | Lu | E06B 9/56 |
| 2014/0216666 | A1 * | 8/2014 | Smith | E06B 9/38 160/84.04 |
| 2016/0010390 | A1 * | 1/2016 | Smith | E06B 9/42 160/315 |

* cited by examiner

*Primary Examiner* — Beth A Stephan
(74) *Attorney, Agent, or Firm* — Che-Yang Chen; Law Office of Michael Chen

(57) ABSTRACT

A window curtain includes a rotary tube located in the top rail, and a curtain is connected between the top rail and the bottom rail. A scrolling device is located in the tube and includes a torsion spring mounted to a fixed shaft. A sleeve is connected to the fixed shaft. An adjustment unit is connected to the fixed shaft. The torsion spring is located between the sleeve and the adjustment unit. The adjustment unit includes a housing, a tubular part and a resilient member. The first end of the torsion spring is fixed to the tubular part. The torsion spring is compressed or released by rotating the adjustment unit. The tubular part includes ratchets which are engaged with a pawl in the housing to maintain the tubular part and the torsion spring from rotating reversely.

4 Claims, 6 Drawing Sheets

DEVICE FOR RESTRICTING TORSION SPRING OF SCROLLING DEVICE OF WINDOW CURTAIN FROM REVERSELY EXPANDING

BACKGROUND OF THE INVENTION

1. Fields of the Invention

The present invention relates to a scrolling device of a window curtain, and more particularly, to an adjustment device cooperating with the scrolling device to restrict the torsion spring of the scrolling device from reversely expanding.

2. Descriptions of Related Art

The conventional scrolling device in a rope-less window curtain includes a torsion spring which provides a force to be balanced with the curtain weight so as to easily operate the curtain.

The torsion spring is connected to a rotary axle, and the torque from the torsion spring makes the rotary axle be rotated. A weight is attached to the bottom rail of the window curtain, and when the weight and the force from the torsion spring reaches a balance status, the curtain can be operated without need of control ropes.

The torsion spring is mounted to a fixed shaft, and a sleeve is connected to one end of the fixed shaft. The combination of the torsion spring, the fixed shaft and the sleeve is received in a tube. When the curtain is pulled downward, the tube is rotated with the curtain to further twist the torsion spring which generate a torque to balance the weight of the bottom rail. When pushing the curtain upward to break the balance mentioned above, only the recovery force of the torsion spring wraps the curtain to the tube, until the user releases the curtain, the weight of the bottom rail and the torque reach a balance again to stop the curtain.

It is noted that the assembling of the torsion spring to the fixed shaft is difficult. This is because the torsion spring has a free end, so that the torsion spring has to be compressed first, and then presses a plate to the free end of the torsion spring. If the assembling steps are not completed within a short period of time, the torsion spring bounces back. The assembling steps have to be repeated again.

The present invention intends to provide an adjustment device that is connected to the scrolling device so as to restrict the torsion spring of the scrolling device from reversely expanding.

SUMMARY OF THE INVENTION

The present invention relates to a window curtain and comprises a top rail, a bottom rail, a tube and a curtain. The tube is located in the top rail. Two plates are respectively connected to two ends of the top rail. The curtain is wrapped around the tube and connected to the bottom rail. A scrolling device is located in the tube and includes a torsion spring, a fixed shaft and a sleeve. The torsion spring is mounted to the sleeve, and the sleeve is connected to the fixed shaft and is secured to the inside of the tube. An adjustment unit is connected to the fixed shaft. The torsion spring is located between the sleeve and the adjustment unit. The adjustment unit includes a housing, a tubular part and a resilient member. The resilient member is mounted to the tubular part which is partially located in the housing. The resilient member is located within the housing and is biased between the housing and the tubular part so that the first end of the tubular part movably protrudes beyond the housing. The first end of the torsion spring is fixed to the tubular part so that the torsion spring is compressed or released by rotating the adjustment unit. One of the two plates includes a tongue that is inserted into the second end of the tubular part to maintain the first end of the tubular part to protrude beyond the housing.

Preferably, a bearing is located between the tube and each of the plates.

Preferably, the tubular part includes ratchets protruding from the second end thereof. The housing includes a pawl protruding from the inside thereof. The pawl is engaged with one of the ratchets to prevent the tubular part from rotating reversely.

Preferably, the tubular part includes a recess defined in the second end of the tubular part. The recess is a rectangular recess which is adapted to receive a tool inserted therein to rotate the tubular part to adjust the torsion spring when the tongue is removed.

The advantages of the present invention are that the adjustment unit maintain the torsion spring from reversely expanding so that the whole combination of the scrolling device and the adjustment unit can easily be installed in the tube.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
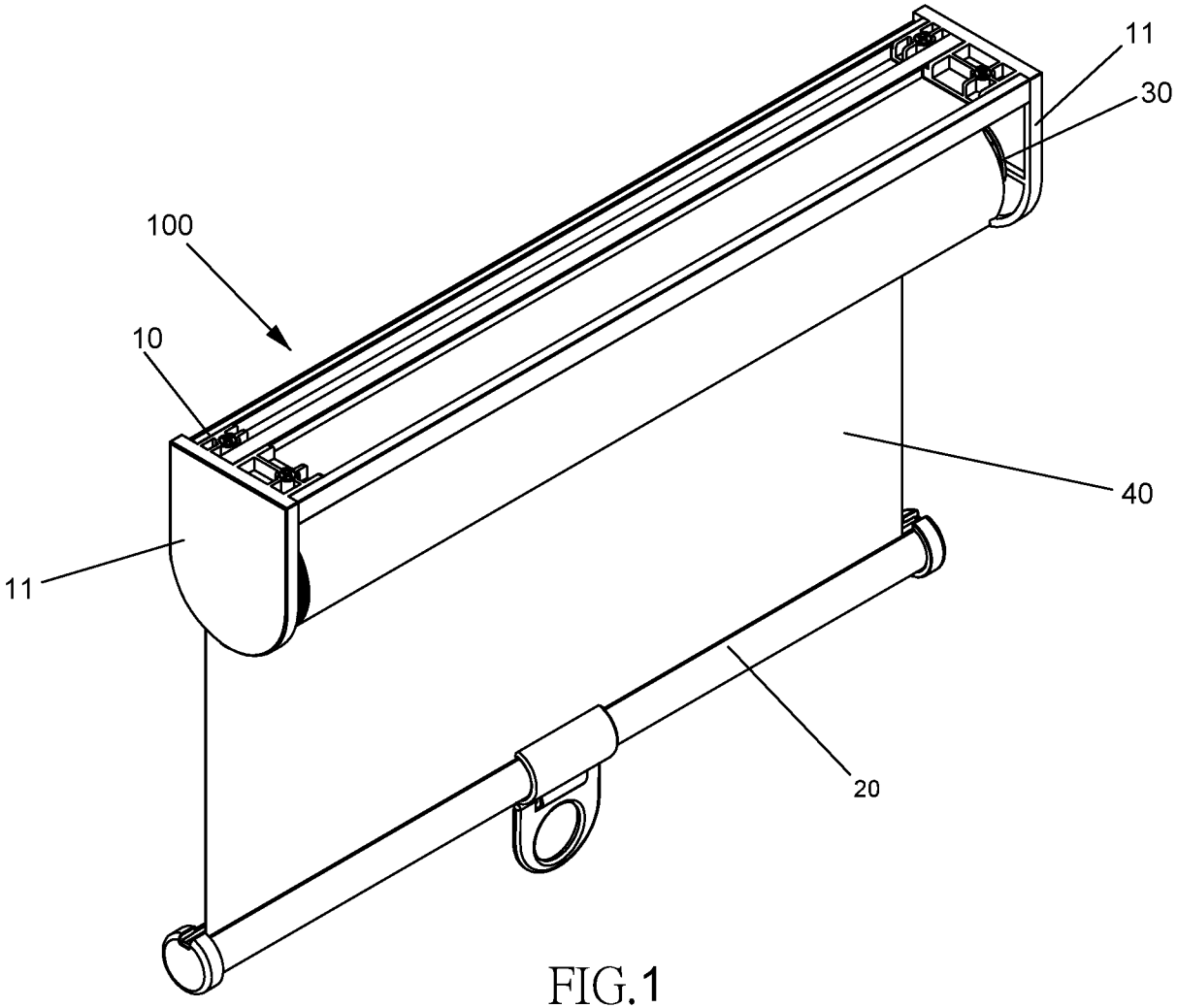
FIG. 1 is a perspective view to show the window curtain using the adjustment unit of the present invention.

Referring to FIGS. 1 to 6, the window curtain 100 of the present invention comprises a top rail 10, a bottom rail 20, a tube 30 and a curtain 40. The tube 30 is located in the top rail 10. Two plates 11 are respectively connected to two ends of the top rail 10. The curtain 40 includes the first end thereof wrapped to the tube 30, and the second end of the curtain 40 is connected to the bottom rail 20. A scrolling device 50 is located in the tube 30 so as to lift or lower the curtain 40. The scrolling device 50 includes a torsion spring 51, a fixed shaft 52 and a sleeve 53. The torsion spring 51 is mounted to the sleeve 53. The sleeve 53 is connected to the fixed shaft 52 and is secured to the inside of the tube 30. The curtain 40 is stopped at a desired position by the force of the torsion spring 51.

An adjustment unit 60 is connected to the fixed shaft 52, and the torsion spring 51 is located between the sleeve 53 and the adjustment unit 60. The adjustment unit 60 includes a housing 61, a tubular part 62 and a resilient member 63. The resilient member 63 is mounted to the tubular part 62 which is partially located in the housing 61. The resilient member 63 is located within the housing 61 and biased between the housing 61 and the tubular part 62 so that the first end of the tubular part 62 movably protrudes beyond the housing 61 by the force from the resilient member 63. The first end of the torsion spring 51 is fixed to the tubular part 62. The torsion spring 51 is compressed or released by rotating the adjustment unit 60. One of the two plates 11 includes a tongue 12 that is inserted into a recess 622 in the second end of the tubular part 62 to maintain the first end of the tubular part 62 to protrude beyond the housing 61. The torsion spring 51 is re-stored an energy. The whole adjustment unit 60 is installed in the tube 30.

Figure 2:
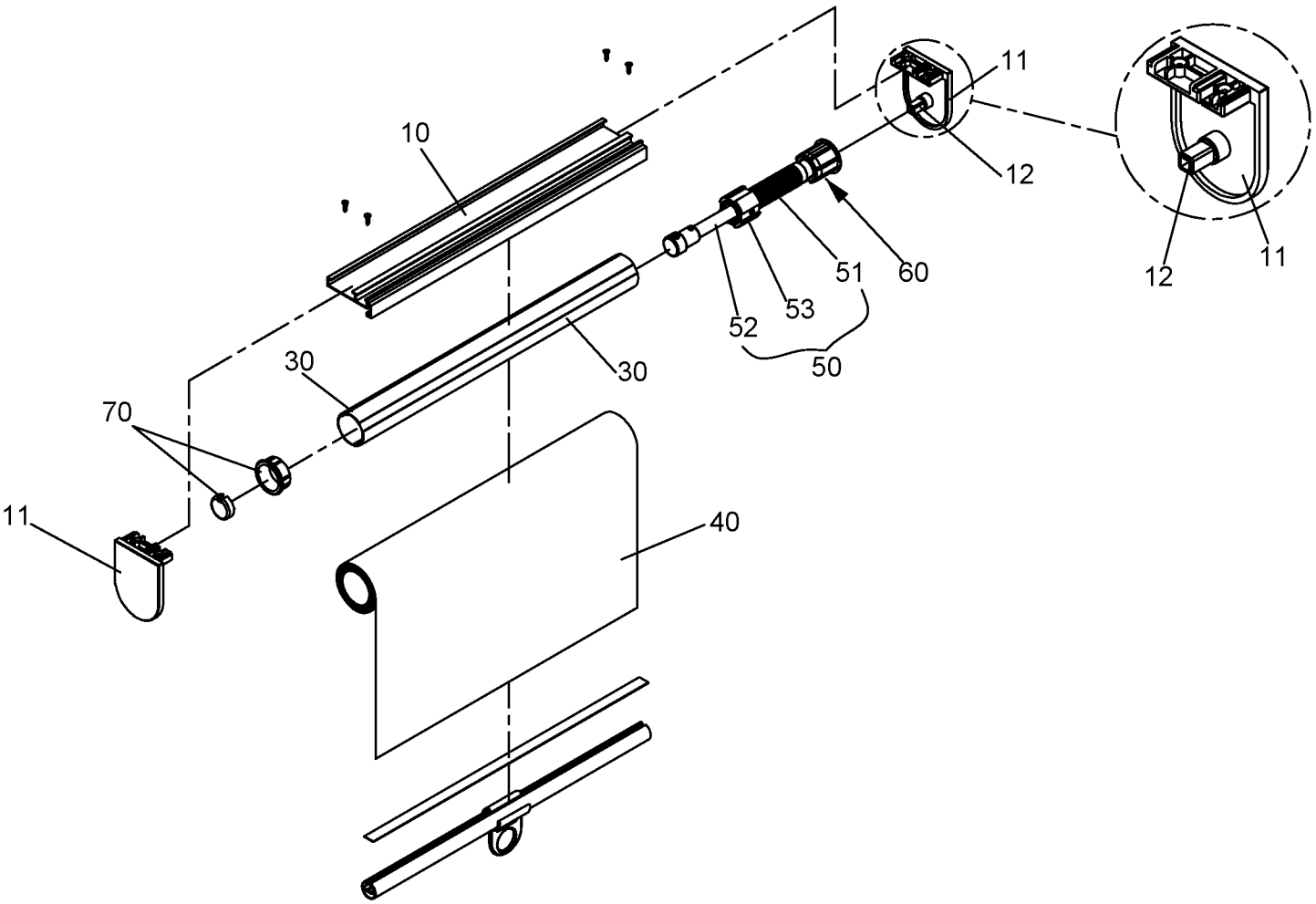
FIG. 2 is an exploded view of the window curtain of the present invention.

As shown in FIG. 2, a bearing 70 is located between the tube 30 and each of the plates 11, so that the tube 30 is rotated smoothly.

Figure 3:
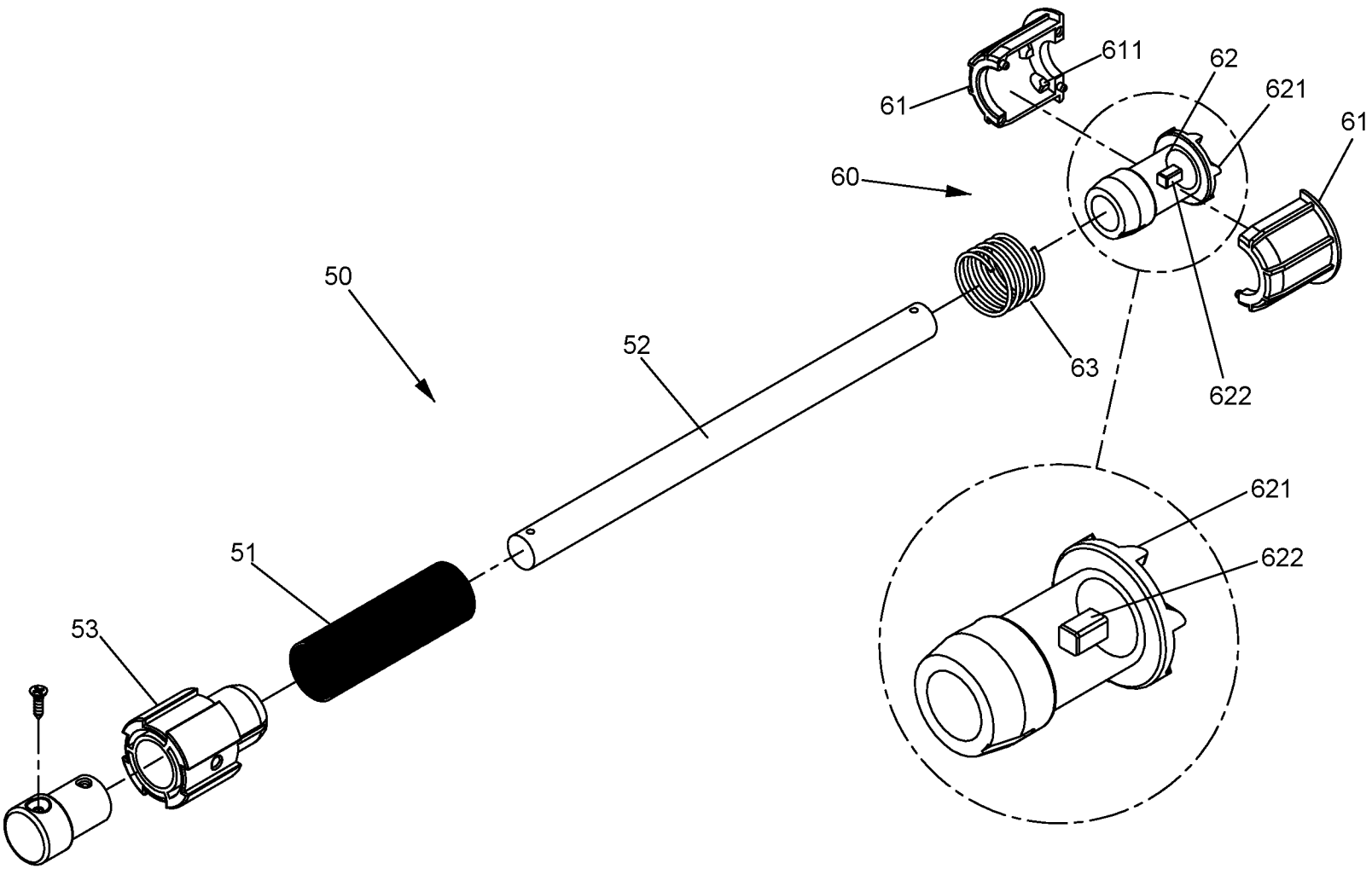
FIG. 3 shows the scrolling device and the adjustment unit of the present invention.

Specifically, as shown in FIGS. 2 and 3, the tubular part 62 includes ratchets 621 protruding from the second end thereof. The housing 61 includes a pawl 611 protruding from the inside thereof. The pawl 611 is engaged with one of the ratchets 621 to prevent the tubular part 62 from rotating reversely. Therefore, the torsion spring 51 is maintained with the pre-stored energy.

As shown in FIG. 3, the tubular part 62 includes the recess 622 defined in the second end of the tubular part 62. In this embodiment, the recess 622 is a rectangular recess 622 so that a tool can be inserted into the recess 622 and rotates the tubular part 62 to adjust the torsion spring 51 when the tongue 12 is removed.

Figure 4:
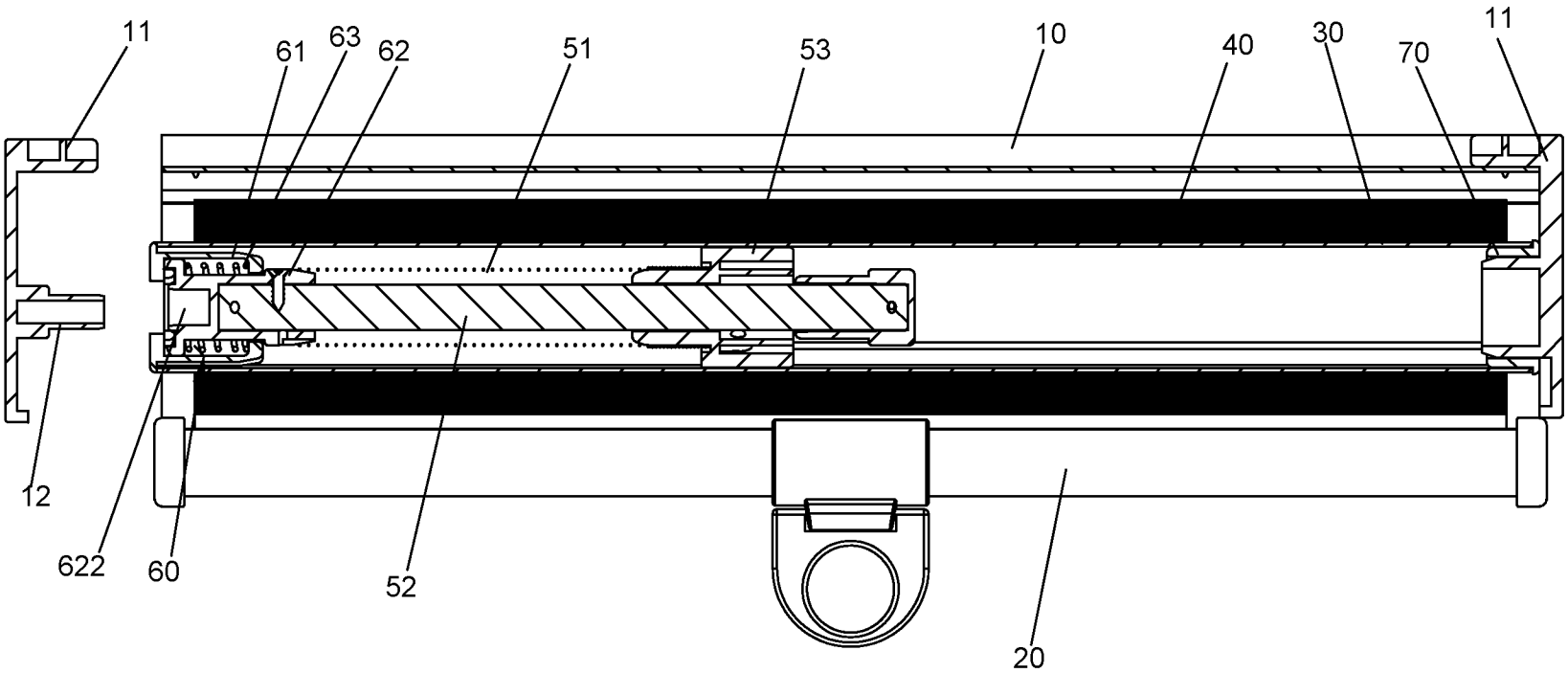
FIG. 4 is a cross sectional view to show the combination of the scrolling device and the adjustment unit are located in the tube, and a plate is to be connected to the second end of the tubular part.
Figure 5:
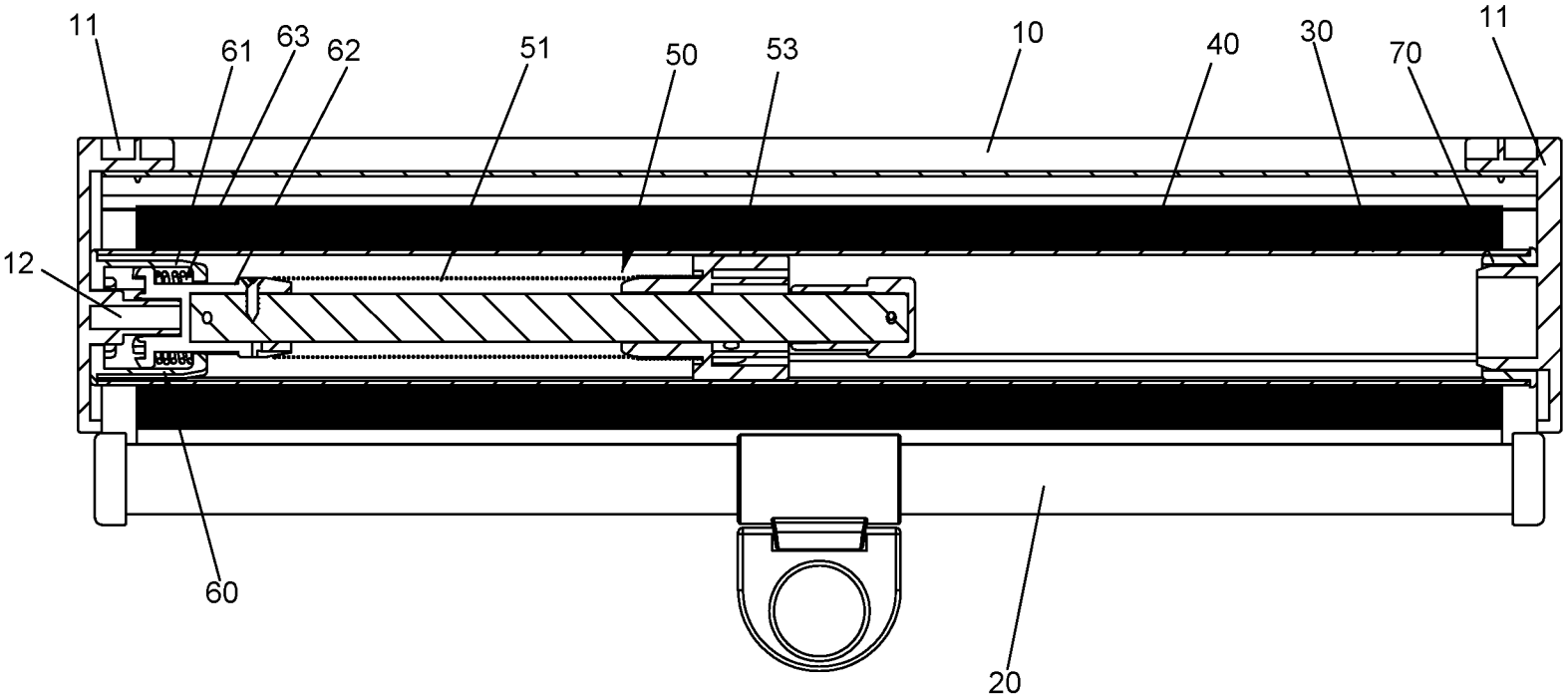
FIG. 5 is a cross sectional view to show that the tubular part is moved toward the sleeve to compress the torsion spring.
Figure 6:
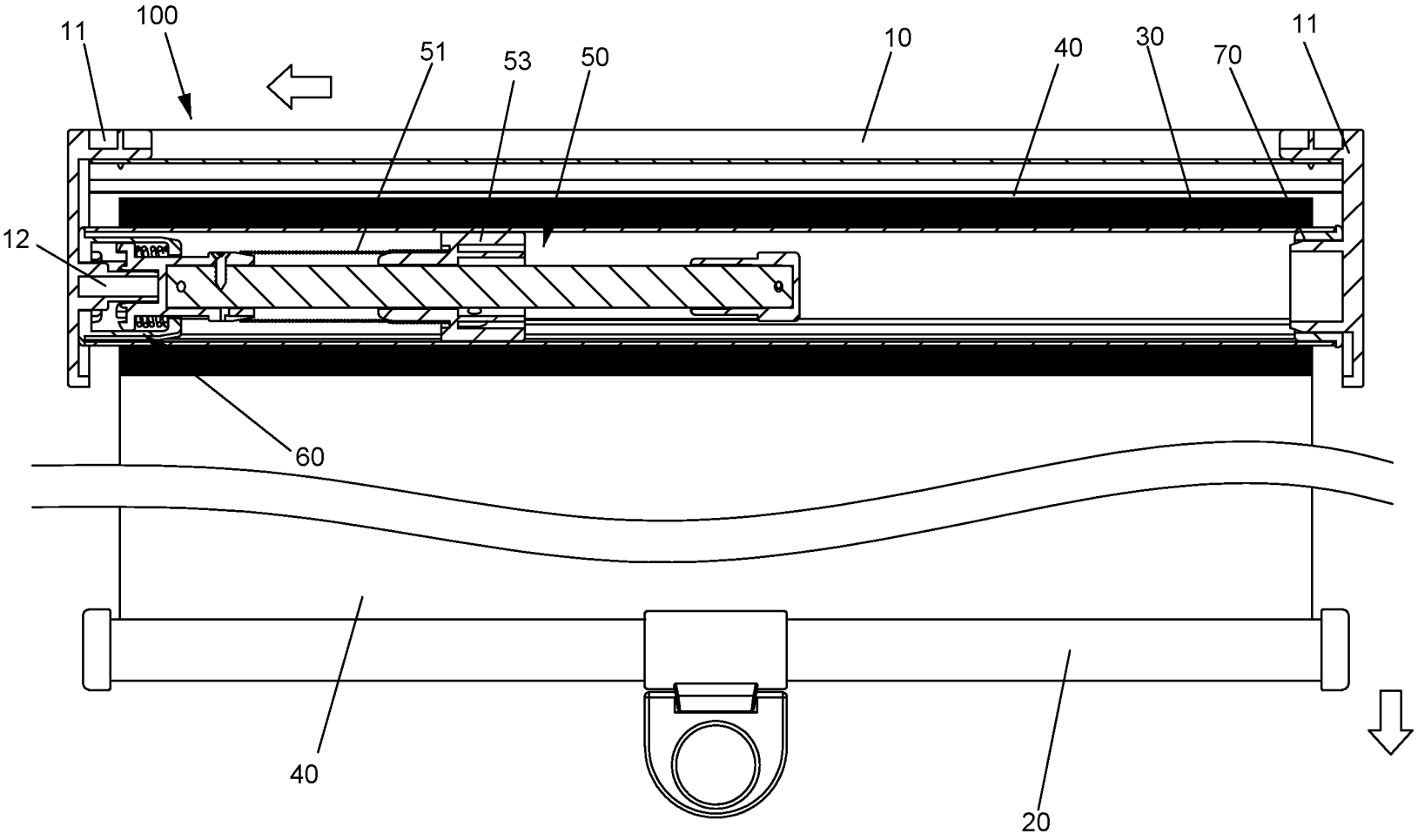
FIG. 6 shows that the curtain of the window curtain is pulled, and the operation of the scrolling device.

As shown in FIGS. 4 to 6, the adjustment unit 60 is located at one end of the torsion spring 51 and is able to adjust the torsion spring 51. One of the two plates 11 is connected to the second end of the tubular part 62 so as to keep the torsion spring 51 in a compressed status, and the combination of the scrolling device 60 and the adjustment unit 60 is received in the tube 30 easily. The curtain 40 can be pulled downward or pushed upward, and is stopped at a desired position by the balance between the force of the torsion spring 51 and the weight of the bottom rail 20.

While we have shown and described the embodiment in accordance with the present invention, it should be clear to those skilled in the art that further embodiments may be made without departing from the scope of the present invention.

What is claimed is:

1. A window blind comprising:

a top rail, a bottom rail, a tube and a curtain, the tube located in the top rail, two plates respectively connected to two ends of the top rail, the curtain having a first end thereof wrapped around the tube, a second end of the curtain connected to the bottom rail;

a scrolling device located in the tube and including a torsion spring, a fixed shaft and a sleeve, the torsion spring mounted to the sleeve, the sleeve connected to the fixed shaft and secured to an inside of the tube, and an adjustment unit connected to the fixed shaft, the torsion spring located between the sleeve and the adjustment unit, the adjustment unit including a housing, a tubular part and a resilient member, the resilient member mounted to the tubular part which is partially located in the housing, the resilient member located within the housing and biased between the housing and the tubular part so that a first end of the tubular part movably protrudes beyond the housing, a first end of the torsion spring fixed to the tubular part, the torsion spring being adjusted by rotating the adjustment unit, one of the two plates including a tongue that is inserted into a second end of the tubular part to maintain the first end of the tubular part to protrude beyond the housing.

2. The window blind as claimed in claim 1, wherein a bearing is located between the tube and each of the plates.

3. The window blind as claimed in claim 1, wherein the tubular part includes ratchets protruding from the second end thereof, the housing includes a pawl protruding from an inside thereof, the pawl engaged with one of the ratchets to prevent the tubular part from rotating reversely.

4. The window blind as claimed in claim 1, wherein the tubular part includes a recess defined in the second end of the tubular part, the recess is a rectangular recess which is adapted to receive a tool inserted therein to rotate the tubular part to adjust the torsion spring when the tongue is removed.

* * * * *